US006193284B1

(12) United States Patent
King

(10) Patent No.: US 6,193,284 B1
(45) Date of Patent: Feb. 27, 2001

(54) CONNECTOR FOR SECURING HEAT EXCHANGER TUBE TO HEATING VESSEL BULKHEAD

(75) Inventor: James D. King, Kettering, OH (US)

(73) Assignee: Henny Penny Corporation, Eaton, OH (US)

( * ) Notice: Subject to any disclaimer, the term of this patent is extended or adjusted under 35 U.S.C. 154(b) by 0 days.

(21) Appl. No.: 09/275,411

(22) Filed: Mar. 24, 1999

Related U.S. Application Data

(60) Provisional application No. 60/079,257, filed on Mar. 25, 1998.

(51) Int. Cl.[7] ..... F16L 27/00

(52) U.S. Cl. ..... 285/139.2; 285/206; 285/148.27

(58) Field of Search ..... 285/206, 148.27, 285/148.23, 89, 61, 139.2, 139.1, 141.1

(56) References Cited

U.S. PATENT DOCUMENTS 2,506,064 * 5/1950 Christie ..... 285/148.27 X
4,645,177 * 2/1987 Moakes ..... 285/148.27 X
5,129,684 * 7/1992 Lawrence et al. ..... 285/148.23 X

* cited by examiner

*Primary Examiner*—Teri Pham
(74) *Attorney, Agent, or Firm*—Baker Botts L.L.P.

(57) ABSTRACT

A connector for connecting a heat exchanger tube to a heating vessel bulkhead, includes a connector housing, a sealing and locking nut, and a first and second o-ring. The connector housing includes a first conduit having an exterior surface, on which are formed a threaded portion, a peripheral bulkhead seating surface, and a first o-ring receiving cavity, such that the first o-ring receiving cavity is positioned between the threaded portion and the peripheral bulkhead seating surface. A bulkhead sealing ring has a second o-ring receiving cavity. A second conduit has a cross-section corresponding to the cross-section of the heat exchanger tube. The sealing nut engages the threaded exterior of the first conduit, and the locking nut engages and locks the sealing nut against the exterior surface of the bulkhead. The first o-ring is positioned within the first o-ring cavity, and the second o-ring is positioned within the second o-ring cavity. The second o-ring is sealed against an interior surface of the bulkhead, and the sealing nut seals the first o-ring against an exterior surface of the bulkhead. The sealing ring has a first port and a second port, such that the first port and the first conduit share a first longitudinal axis. The first port adjoins a first end of the first conduit adjacent to the peripheral bulkhead sealing surface. The second port adjoins a first end of the second conduit.

14 Claims, 6 Drawing Sheets

CONNECTOR FOR SECURING HEAT EXCHANGER TUBE TO HEATING VESSEL BULKHEAD

This appn. claims the benefit of U.S. Provisional No. 60/079,257 filed Mar. 25, 1998.

BACKGROUND OF THE INVENTION

1. Field of the Invention

The invention relates generally to apparatus for connecting heat exchanger tubes to the bulkheads of heating vessels, such as deep fat fryer cooking vessels. In particular, the invention relates to connectors for joining heat exchanger tubes to the bulkheads of fryer vessels so as not to interfere with the insertion of racks and other food product holding apparatus into the fryer. Moreover, the invention particularly relates to cooking apparatus including such connectors and to connector housings used in the fabrication of such connectors.

2. Description of Related Art

Commercial users of open well and pressure fired fryers have become increasingly aware of the costs associated with operating and maintaining their equipment. Unfortunately, existing devices have significant disadvantages in the areas of thermal efficiency and maintenance and repair. In particular, conventional techniques of welding fryer heating vessels and heat exchanger apparatus together makes their maintenance more expensive. Specifically, both the fryer heating vessels and heat exchanger apparatus may require replacement in order to repair or replace a portion of the fryer, causing existing devices to have high maintenance costs.

Heat exchanger apparatus including interior conduit for heated combustion products are frequently used in flyer heating vessels. An example of such an interior heating system is described in U.S. Pat. No. 4,751,915. A conduit through the lower portions of the vessel carries heated combustion products from the front wall to the rear wall of the vessel. These straight heat exchanger tubes may operate in a low pressure system with burner pressures in a range of about 0.25" water column to about 0.50" water column.

Unfortunately, uniform temperature control is not achieved with such systems. The cooking medium, such as cooking oil, in the lower region of the vessel may have a higher temperature because of its proximity to the straight heat exchanger tubes. Some interior heating systems also may have only a single direction of flow for combustion products. Because combustion products cool as they transfer heat to the cooking medium, such straight heat exchanger tubes tend to transfer more heat to the front portion of the vessel than to the rear potion. These factors may combine to produce erratic and non-uniform temperature distributions. High and nonuniform temperatures also may cause excessive thermal stresses to develop in the vessel walls and any welds therein. Subsequent structural fatigue of the vessel wall may increase the frequency of necessary vessel replacement.

As described in U.S. Pat. No. 5,402,713, the disclosure of which is incorporated herein by reference, a deep fat fryer vessel may include an interior array for heat exchanger tubes arranged in a U-shaped configuration along the sides and rear of the vessel. Referring to FIG. 1, heat exchanger tubes 2 may be positioned in the interior of the vessel 1 with the ends attached to the front vessel bulkheads by means of a mechanical fastening on the exterior side of the vessel bulkhead and a seal on the interior side of the vessel bulkhead. Referring to FIGS. 2 and 3, a bulkhead fitting 3 may be welded to the ends of two heat exchanger tubes 2 secured to the interior of the vessel by fasteners 17.

Each heat exchanger tube may employ one or more premix burner components which fire directly into the heat exchanger tube from one end. Each heat exchanger tube also may have its burners on either end of the tube. The combustion gases produced by the burners travel through the heat exchanger tube and exit into a combustion channel. Tubes 2 may be shaped and arranged to provide adequate space in vessel 1 to insert a rack 4 for holding food products into the center of the U-shaped tube configuration. The combustion channel directs the gases exiting the heat exchanger tube around and in contact with at least a portion of the exterior wall of the vessel and then to an exhaust flue at the rear of the vessel.

SUMMARY OF THE INVENTION

Thus, a need has arisen for a connector for securing heat exchanger tubes to a heating vessel bulkhead that is sufficiently strong to withstand the rapidly changing thermal conditions within the fryer heating vessel and within the heat exchanger tube. It is a feature of the invention that it better withstands the thermal expansion and contraction associated with the operation of the fryer, than does a welded connection. It is another feature of the invention that better withstands the vibration and pressure fluctuations associated with the operation of the fryer, than does a welded or a fastened connection. It is an advantage of the invention that the connector creates both a seal on the interior and exterior of the vessel bulkhead.

A further need has arisen for a connector that creates a fluid tight seal between the heat exchanger tube and the vessel bulkhead, but which permits the heat exchanger tube to be disconnected and removed for repair or replacement. It is a feature of the invention that a sealing nut may be tightened to establish an air tight seal between the connector and the vessel bulkhead on both the interior and the exterior of the vessel. Although the sealing nut may be loosened to remove the heat exchanger tube, a locking nut ensures a tight seal and prevents the heat exchanger tube connector from coming loose inadvertently.

In an embodiment of the invention, a connector is used for connecting a heat exchanger tube to a heating vessel bulkhead. The connector comprises a connector housing, a sealing nut and a locking nut, and a first and second o-ring. The connector housing may include a first conduit having an exterior surface, on which are formed a threaded portion, a peripheral bulkhead sealing surface, and a first o-ring receiving cavity, such that the first o-ring receiving cavity is positioned between the threaded portion and the peripheral bulkhead sealing surface. The connector housing also may include a bulkhead sealing ring having a second o-ring receiving cavity; and a second conduit having a cross-section corresponding to the cross-section of the heat exchanger tube. The sealing nut engages the threaded exterior of the first conduit, and the locking nut engages and locks the sealing nut against the exterior surface of the bulkhead. The first o-ring is positioned within the first o-ring cavity, and a second o-ring is positioned within the second o-ring cavity, wherein the second o-ring is sealed against an interior surface of the bulkhead and the sealing nut seals the first o-ring against an exterior surface of the bulkhead. The sealing ring has a first port and a second port, such that the first port and the first conduit share a first longitudinal axis and the first port adjoins a first end of the first conduit adjacent to the peripheral bulkhead sealing surface. The second port adjoins a first end of the second conduit.

In another embodiment of the invention, the connector again may comprise a connector housing, a sealing nut and a locking nut, and a first and second o-ring. The connector housing includes a conduit having a first conduit portion having a first radius and a first longitudinal axis and a second conduit portion having a second radius and a second longitudinal axis, and a flange extending circumferentially from the first conduit portion. The first conduit portion has a first radius and an exterior surface, on which are formed a threaded portion, a peripheral bulkhead seating surface, and a first o-ring receiving cavity. The first o-ring receiving cavity is positioned between the threaded portion and the peripheral bulkhead seating surface. The second conduit portion has a second radius, such that a cross-section of the second conduit portion corresponds to the cross-section of the heat exchanger tube. The flange includes a second o-ring receiving cavity. The sealing nut is secured to the threaded exterior of the first conduit portion, and the locking nut is secured to the threaded exterior of the first conduit portion. Thus, the sealing nut is locked against the exterior surface of the bulkhead. The first o-ring is positioned within the first o-ring cavity, and a second o-ring is positioned within the second o-ring cavity. The second o-ring is sealed against an interior surface of the bulkhead, and the sealing nut seals the first o-ring against an exterior surface of the bulkhead.

In yet another embodiment of the invention, a connector housing is described for connecting a heat exchanger tube to a heating vessel bulkhead. The connector housing comprises a first conduit, a bulkhead sealing ring, and a second conduit. The first conduit has an exterior surface, on which are formed a threaded portion, a peripheral bulkhead seating surface, and a first o-ring receiving cavity. The first o-ring receiving cavity is positioned between the threaded portion and the peripheral bulkhead seating surface. The bulkhead sealing ring has a second o-ring receiving cavity. The sealing ring has a first port and a second port, such that the first port and the first conduit share a first longitudinal axis, and the first port adjoins a first end of the first conduit adjacent to the peripheral bulkhead seating surface. The second conduit has a cross-section corresponding to the cross-section of the heat exchanger tube. The second port adjoins a first end of the second conduit.

In still another embodiment of the invention, a heating apparatus comprises a heating vessel, at least one connector, and at least one heat exchanger tube. The heating vessel has at least one heating vessel bulkhead and at least one hole formed in the at least one bulkhead. The at least one heat exchanger tube has at least one open end. The at least one connector is secured within the at least one hole. The at least one connector comprises a connector housing, a sealing nut and a locking nut, and a first and second o-ring. The connector housing includes a first conduit having an exterior surface, on which are formed a threaded portion, a peripheral bulkhead seating surface, and a first o-ring receiving cavity. The first o-ring receiving cavity is positioned between the threaded portion and the peripheral bulkhead seating surface. A bulkhead sealing ring has a second o-ring receiving cavity. A second conduit has a cross-section corresponding to the cross-section of the at least one open end of at least one heat exchanger tube. The sealing nut engages the threaded exterior of the first conduit, and the locking nut engages and locks the sealing nut against the exterior surface of the bulkhead. The first o-ring is positioned within the first o-ring cavity, and a second o-ring is positioned within the second o-ring cavity. The second o-ring is sealed against an interior surface of the at least one bulkhead, and the sealing nut seals the first o-ring against an exterior surface of the at least one bulkhead. The sealing ring has a first port and a second port, such that the first port and the first conduit share a first longitudinal axis and the first port adjoins a first end of the first conduit adjacent to the peripheral bulkhead seating surface. The second port adjoins a first end of the second conduit. The at least one open end of the heat exchanger tube is secured in the second conduit.

Other objects, features, and advantages will be apparent to persons of ordinary skill in the art in view of the following detailed description of preferred embodiments and the accompanying drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings in which.

DETAILED DESCRIPTION OF PREFERRED EMBODIMENTS

Preferred embodiments of the present invention and their advantages are best understood by referring to FIGS. 4–9, like numerals being used for like corresponding parts in the various drawings.

Figure 4:
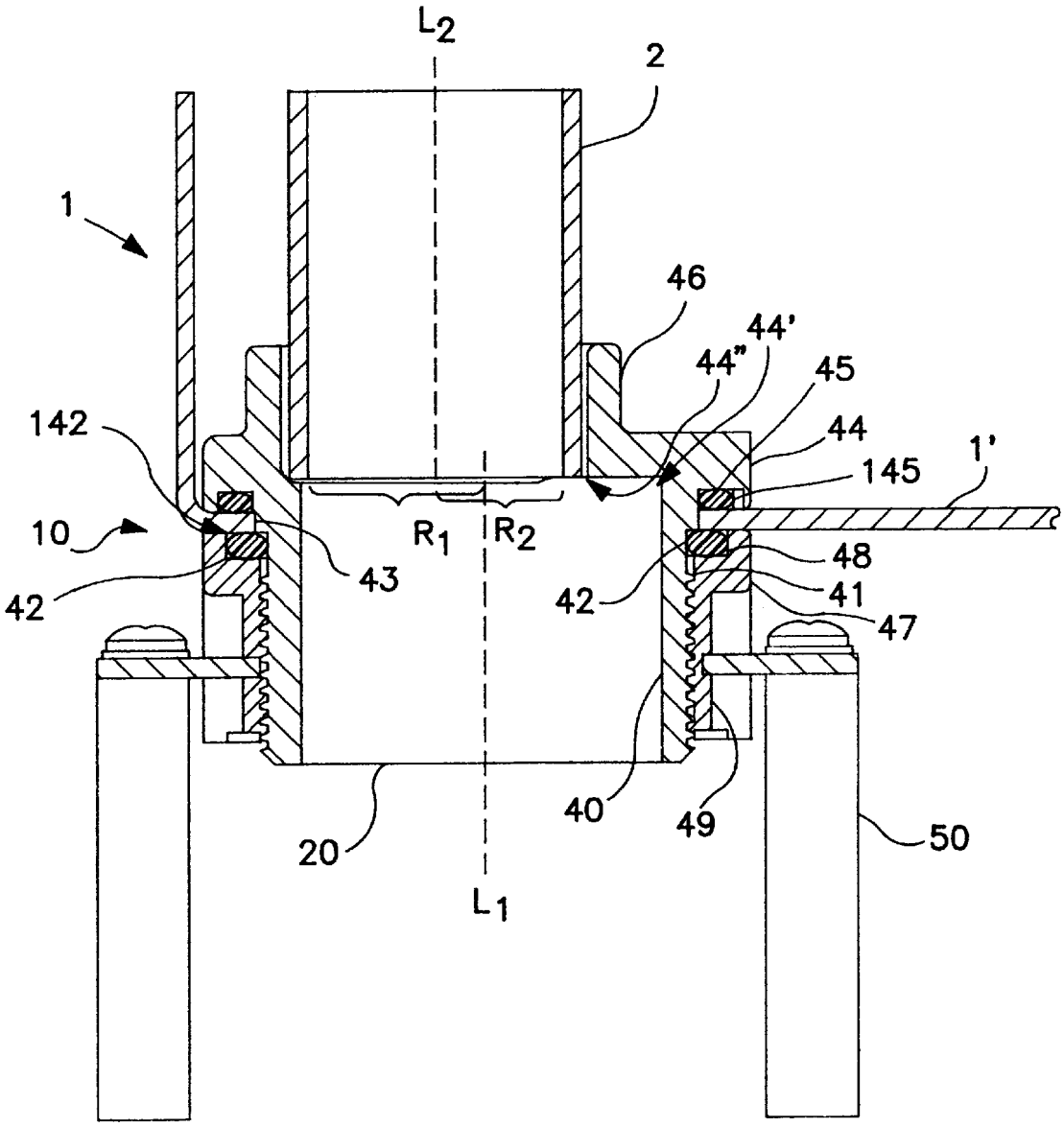
FIG. 4 is a cross-sectional view of a connector according to the present invention securing a heat exchanger tube to a vessel bulkhead.

Referring to FIG. 4, a cross-sectional view of a connector 10 according to the present invention is depicted securing heat exchanger tube 2 to vessel bulkhead 1'. Connector 10 includes a connector housing 20. Connector housing 20 includes a first conduit 40, a bulkhead sealing ring 44, and a second conduit 46. On its exterior surface, first conduit 40 includes a threaded portion 41 and a peripheral bulkhead seating surface 43. When connector housing 20 is inserted into a hole formed in vessel bulkhead 1', seating surface 43 abuts the circumference of the hole. A first o-ring cavity 42 is positioned between threaded portion 41 and seating surface 43 on the exterior surface of first conduit 40.

Figure 1:
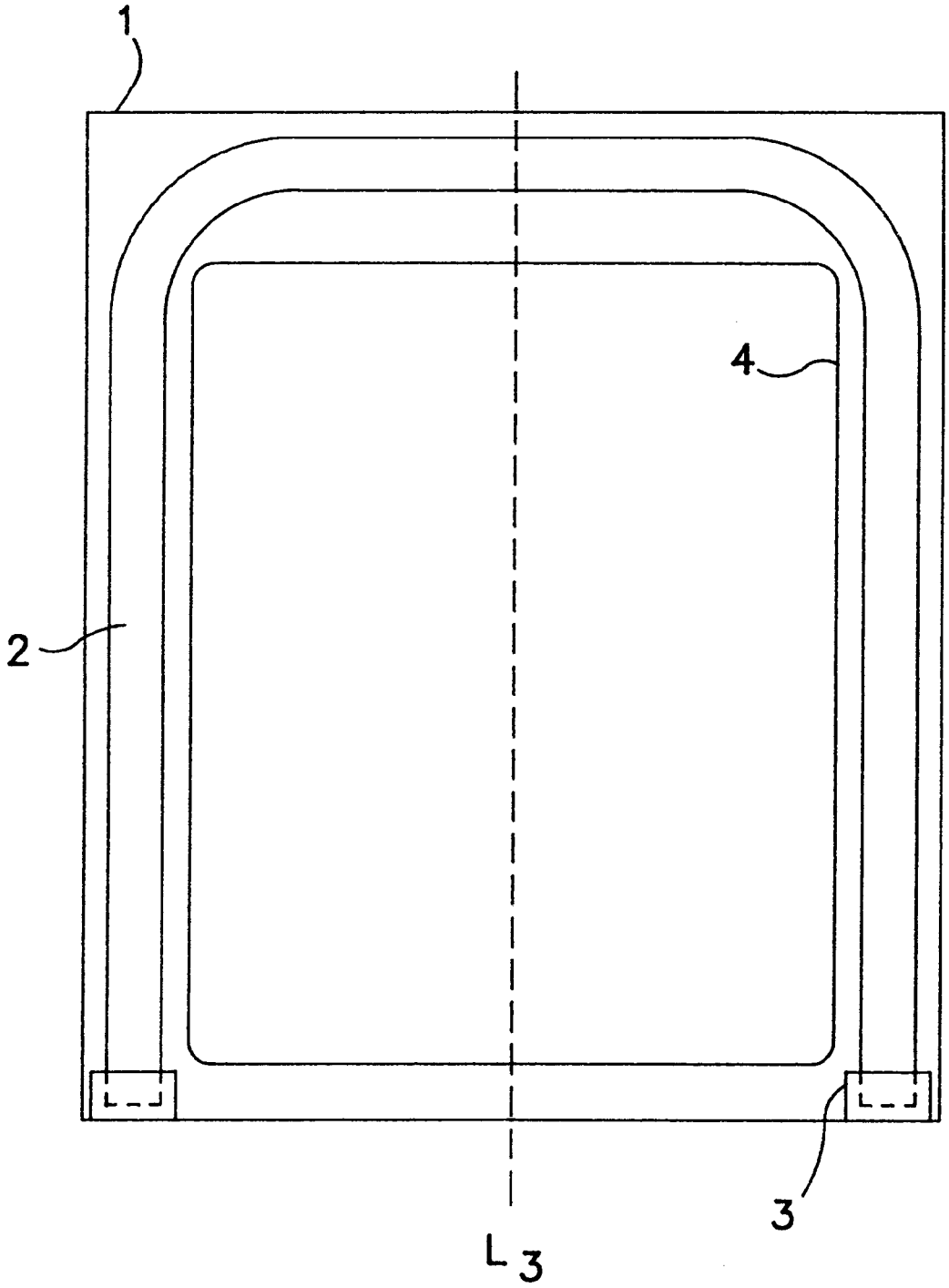
FIG. 1 PRIOR ART
FIG. 1 is a overhead, schematic view of a known heating vessel configuration.
Figure 2:
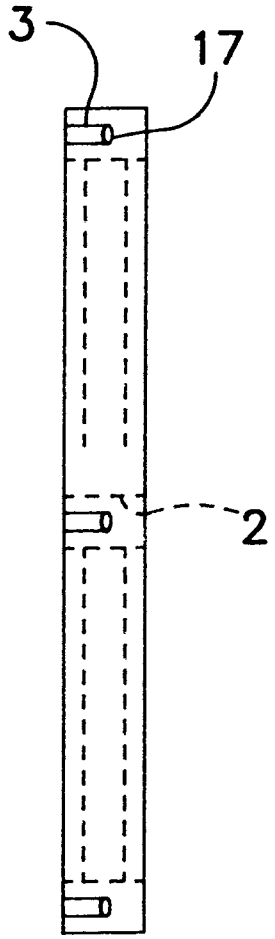
FIG. 2 PRIOR ART
FIG. 2 is a cut-away view of bulkhead fitting 3 of FIG. 1.
Figure 3:
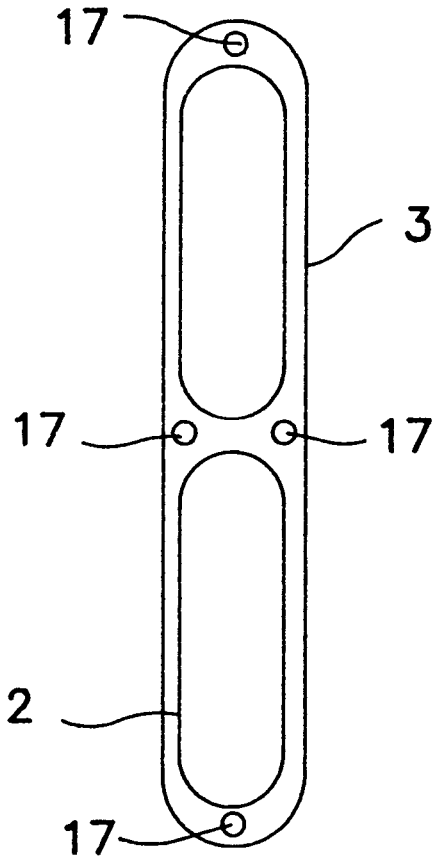
FIG. 3 PRIOR ART
FIG. 3 is a front view of bulkhead fitting 3 of FIG. 1.

Bulkhead sealing ring 44 surrounds first conduit 40. A second o-ring cavity 45 is formed in sealing ring 44 on the surface facing first conduit 40. Sealing ring 44 also includes two ports. A first port 44' adjoins a first end of first conduit 40, and first port 44' and first conduit 40 share a common longitudinal axis $L_1$. Similarly, a second port 44" adjoins a first end of second conduit 46, and second port 44" and second conduit 46 share a common longitudinal axis $L_2$. Longitudinal axis $L_2$ is offset radially from longitudinal axis $L_1$ and from longitudinal axis $L_3$, depicted in FIG. 1. This offset makes more space available in the center of heating vessel 1 to receive a wire basket or carrier tray (e.g., rack 4 from FIG. 1) for holding food products, or the like. In addition, a radius $R_2$ of a second port 44" corresponds to the radius of second conduit 46. Radius $R_2$ may be less than a radius $R_1$ of first port 44' and first conduit 40. This difference may be attributable to the shape of heat exchanger tube 2 which is secured in second conduit 46. Moreover, in order to further increase the space available in the center of heating vessel 1, heat exchanger tubes 2 may be oval-shaped to reduce the distance that tubes 2 extend toward the center of heating vessel 1.

Figure 5:
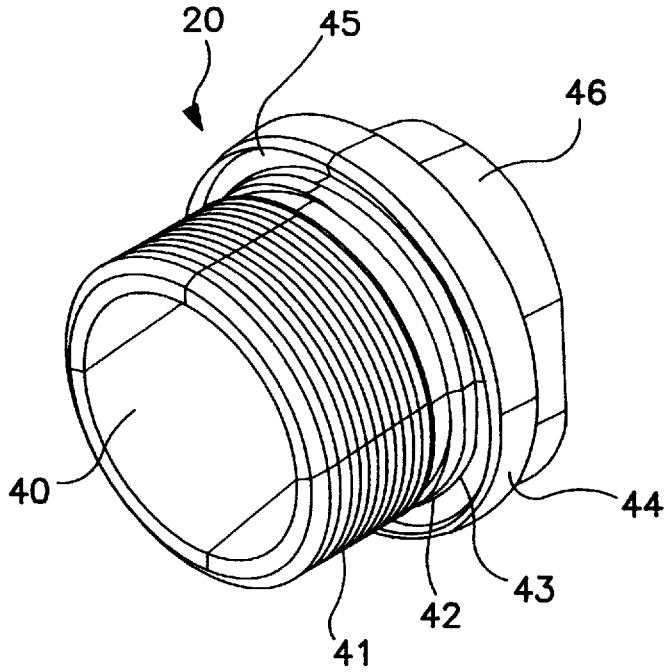
FIG. 5 is a front, perspective view of a connector housing.
Figure 6:
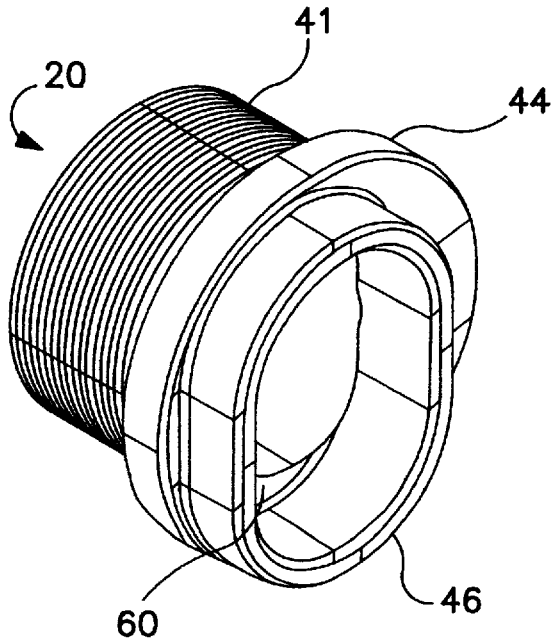
FIG. 6 is a rear, perspective view of the connector housing of FIG. 5.

Referring to FIG. 5, a front, perspective view of connector housing 20 is depicted. In this view, first conduit 40 is depicted has having a cylindrical exterior surface and a substantially cylindrical interior. FIG. 6 depicts a rear, perspective view of connector housing 20 of FIG. 5. In this view, second conduit 46 is shown to have a oval-shaped cross-section. For the reasons discussed above, oval-shaped heat exchanger tubes 2 received by second conduit 46 may increase the space available in the center of heating vessel 1. In addition, because of the difference in the shapes of first conduit 40 and second conduit 46 and the offset in their longitudinal axes $L_1$ and $L_2$, a heat exchanger tube positioning lip 60 is formed in connector housing 20. Thus, heat exchanger tubes 2 secured in second conduit 46 abut positioning lip 60.

When connector housing 20 is inserted into the hole in vessel bulkhead 1', a second o-ring 145 is placed in second o-ring cavity 45. Second o-ring 145 is then sandwiched between bulkhead sealing ring 44 and vessel bulkhead 1'. Similarly, a first o-ring 142 is placed in first o-ring cavity 42 on first conduit 40. The o-rings may be made from metallic or non-metallic materials. However, first o-ring 142 and second o-ring 145 are preferably made from metal in order to better withstand the temperatures and thermal stresses to which these o-rings are exposed. In particular, it is preferred that these o-rings be manufactured from a uncoated 321 stainless steel or silver-plated (i.e., coated), 321 stainless steel. The silver plating provides additional resiliency to the stainless steel o-rings. Such stainless steel o-rings are available commercially from Helicoflex Company of Alabama, U.S.A.

Figure 7:
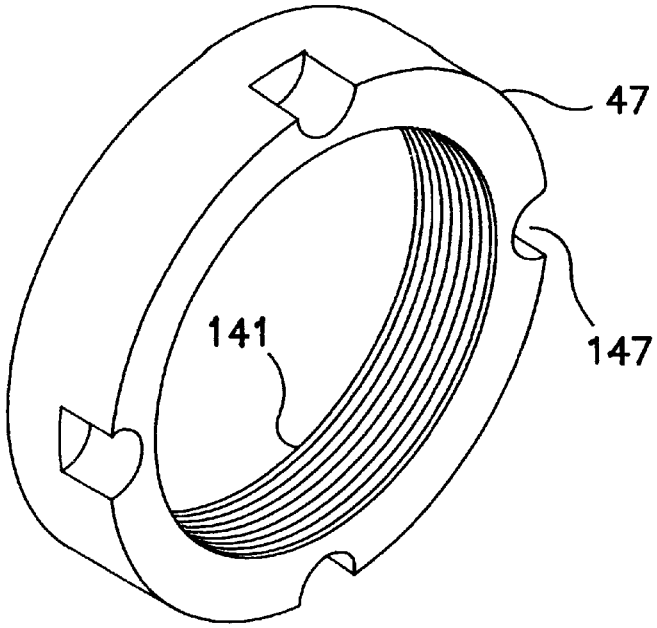
FIG. 7 is a front perspective view of a sealing nut.
Figure 8:
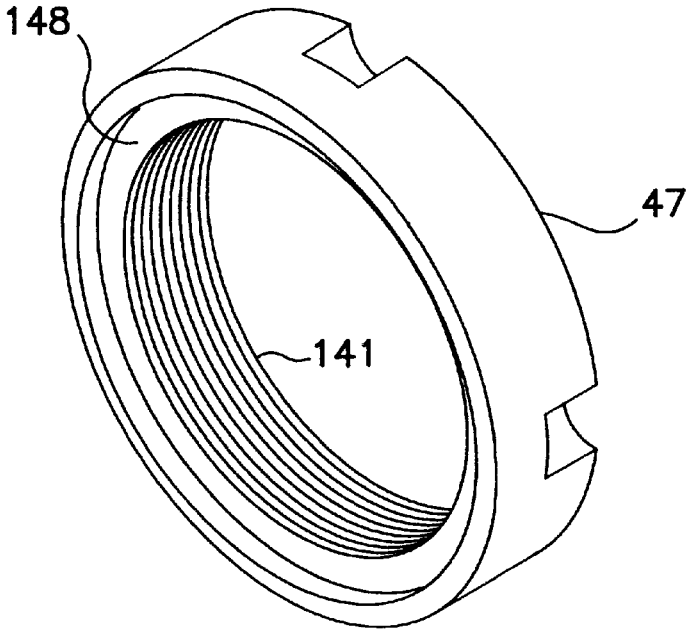
FIG. 8 is a rear, perspective view of the sealing nut of FIG. 7.

First o-ring 142 is sandwiched between conduit 40 and vessel bulkhead 1' by a sealing nut 47. Referring to FIG. 7, a front perspective view of sealing nut 47 is depicted. Sealing nut 47 has a threaded internal surface 141 which corresponds to threaded portion 41 on first conduit 40. Sealing nut 47 is also equipped with a plurality of turning points 147 by which sealing nut 47 may be threaded securely onto first conduit 40 and against vessel bulkhead 1'. Referring to FIG. 8, a rear, perspective view of sealing nut 47 of FIG. 7 is depicted. From this rear perspective, sealing nut 47 is seen to have a first o-ring cavity cover 148. First o-ring cavity cover 148 aids in sealing first o-ring 142 against vessel bulkhead 1', and may hold a sealing washer 48 to further improve this seal.

Figure 9:
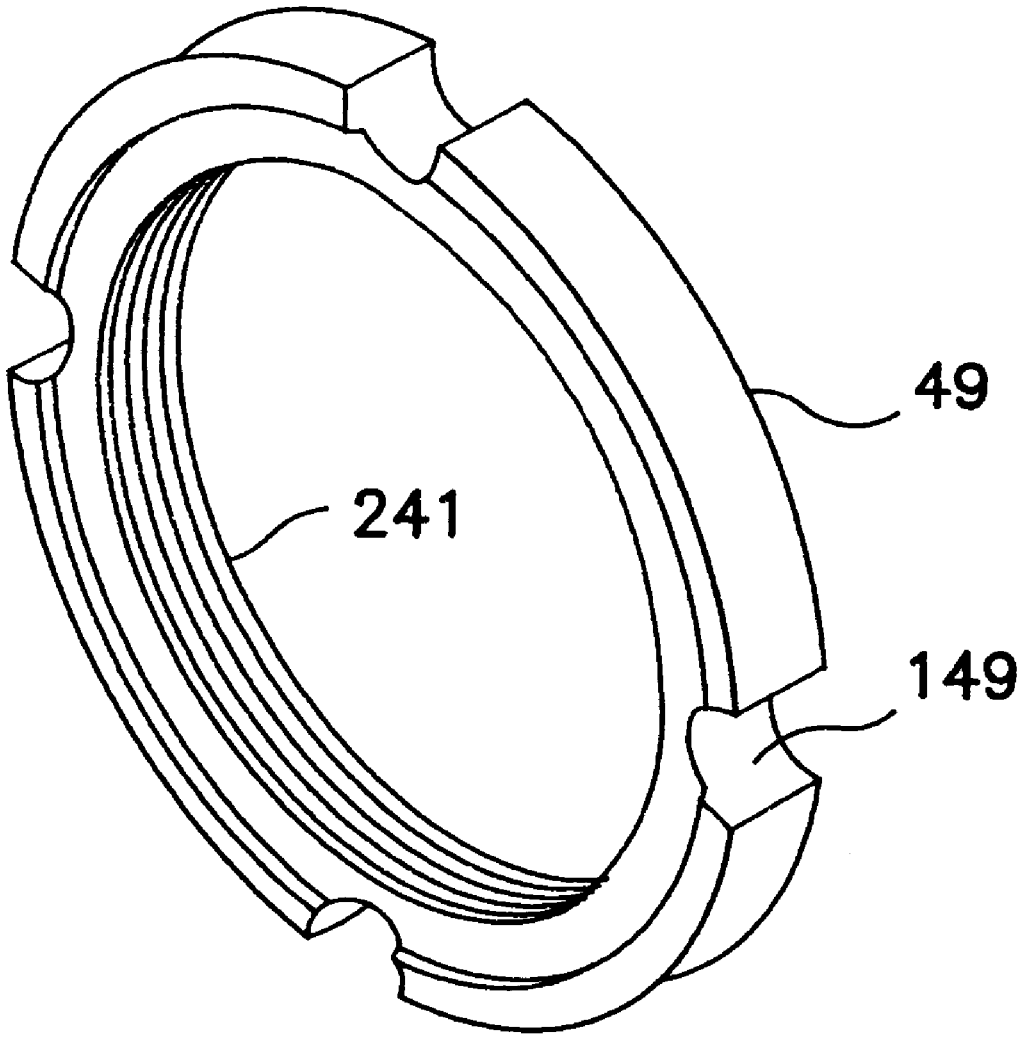
FIG. 9 is a rear perspective view of a locking nut.

Once sealing nut 47 has been threaded on to first conduit 40, a locking nut 49 is threaded on to first conduit 40 behind sealing nut 47 to secure sealing nut 47 against vessel bulkhead 1'. Referring to FIG. 9, a rear perspective view of locking nut 49 is depicted. Locking nut 49 has a threaded internal surface 241 which corresponds to threaded portion 41 on first conduit 40. As with sealing nut 47, locking nut 49 is also equipped with a plurality of turning points 149, by which locking nut 49 may be threaded sucurely onto first conduit 40 and against sealing nut 47. Turning points 147 on sealing nut 47 and turning points 149 on locking nut 49 are designed to be secured by a wrench having a plurality of tines which are adapted to fit these turning points.

Referring again to FIG. 4, a burner mounting frame 50 is shown secured to the exterior portion of connector 10. Although removable, connector 10 is secured sufficiently to heating vessel 1 to support the burner connections (not shown).

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification is considered as exemplary only, with the true scope and spirit of the invention being indicated by the following claims.

I claim:

1. A connector for connecting a heat exchanger tube to a heating vessel bulkhead, comprising:

a connector housing including:

a first conduit having an exterior surface, on which are formed a threaded portion, a peripheral bulkhead seating surface, and a first o-ring receiving cavity, such that said first o-ring receiving cavity is positioned between said threaded portion and said peripheral bulkhead seating surface;

a bulkhead sealing ring having a second o-ring receiving cavity; and a second conduit having a cross-section corresponding to the cross-section of said heat exchanger tube;

a sealing nut engaging said threaded exterior of said first conduit;

a locking nut engaging and locks said sealing nut against said exterior surface of said bulkhead; and a first o-ring positioned within said first o-ring cavity and a second o-ring positioned within said second o-ring cavity, wherein said second o-ring is sealed against an interior surface of said bulkhead and said sealing nut seals said first o-ring against an exterior surface of said bulkhead;

wherein said sealing ring has a first port and a second port, such that said first port and said first conduit share a first longitudinal axis and said first port adjoins a first end of said first conduit adjacent to said peripheral bulkhead seating surface; and wherein said second port adjoins a first end of said second conduit.

2. The connector of claim 1, wherein said second conduit has a second longitudinal axis, said second longitudinal axis being offset radially from said first longitudinal axis.

3. The connector of claim 2 whereby said sealing ring forms a heat exchanger tube positioning lip traversing a portion of said second port, such that a heat exchanger tube affixed in said second conduit abuts said positioning lip.

4. The connector of claim 1, wherein said sealing nut further seals a seal washer against said first o-ring.

5. The connector of claim 1, wherein said first and said second o-rings are made from metal.

6. The connector of claim 5, wherein said metal is stainless steel.

7. The connector of claim 1, wherein said second conduit has an oval cross-section.

8. A connector for connecting a heat exchanger tube to a heating vessel bulkhead, comprising a connector housing including a conduit having a first conduit portion having a first radius and a first longitudinal axis and a second conduit portion having a second radius and a second longitudinal axis, and a flange extending circumferentially from said first conduit portion; wherein said first conduit portion has a first radius and an exterior surface, on which are formed a threaded portion, a peripheral bulkhead seating surface, and a first o-ring receiving cavity, such that said first o-ring receiving cavity is positioned between said threaded portion and said peripheral bulkhead seating surface; wherein said second conduit portion has a second radius, such that a cross-section of said second conduit portion corresponds to the cross-section of said heat exchanger tube; and wherein said flange includes a second o-ring receiving cavity;

a sealing nut secured to said threaded exterior of said first conduit portion;

a locking nut secured to said threaded exterior of said first conduit portion, whereby said sealing nut is locked against said exterior surface of said bulkhead; and a first o-ring positioned within said first o-ring cavity and a second o-ring positioned within said second o-ring cavity, wherein said second o-ring is sealed against an interior surface of said bulkhead and said sealing nut seals said first o-ring against an exterior surface of said bulkhead.

9. A connector housing for connecting a heat exchanger tube to a heating vessel bulkhead, comprising:

a first conduit having an exterior surface, on which are formed a threaded portion, a peripheral bulkhead seating surface, and a first o-ring receiving cavity, such that said first o-ring receiving cavity is positioned between said threaded portion and said peripheral bulkhead seating surface;

a bulkhead sealing ring having a second o-ring receiving cavity;

a second conduit having a cross-section corresponding to the cross-section of said heat exchanger tube;

wherein said sealing ring has a first port and a second port, such that said first port and said first conduit share a first longitudinal axis and said first port adjoins a first end of said first conduit adjacent to said peripheral bulkhead seating surface and said second port adjoins a first end of said second conduit;

wherein said second conduit has a second longitudinal axis, said second longitudinal axis being offset radially from said first longitudinal axis.

10. The connector housing of claim 9, wherein said second conduit has an oval cross-section.

11. The connector housing of claim 9, wherein said sealing ring forms a heat exchanger tube positioning lip traversing a portion of said second port, such that a heat exchanger tube affixed in said second conduit abuts said positioning lip.

12. A heating apparatus comprising:

a heating vessel having at least one heating vessel bulkhead and at least one hole formed in said at least one bulkhead;

at least one heat exchanger tube having at least one open end; and at least one connector, said at least one connector secured within said at least one hole and said at least one connector comprising:

a connector housing including a first conduit having an exterior surface, on which are formed a threaded portion, a peripheral bulkhead seating surface, and a first o-ring receiving cavity, such that said first o-ring receiving cavity positioned between said threaded portion and said peripheral bulkhead seating surface; a bulkhead sealing ring having a second o-ring receiving cavity; and a second conduit having a cross-section corresponding to the cross-section of said at least one open end of at least one heat exchanger tube;

a sealing nut engaging said threaded exterior of said first conduit;

a locking nut engaging and locking said sealing nut against said exterior surface of said bulkhead; and a first o-ring positioned within said first o-ring cavity and a second o-ring positioned within said second o-ring cavity, wherein said second o-ring is sealed against an interior surface of said at least one bulkhead and said sealing nut seals said first o-ring against an exterior surface of said at least one bulkhead;

wherein said sealing ring has a first port and a second port, such that said first port and said first conduit share a first longitudinal axis and said first port adjoins a first end of said first conduit adjacent to said peripheral bulkhead seating surface; wherein said second port adjoins a first end of said second conduit; and wherein said at least one open end of said heat exchanger tube is secured in said second conduit.

13. The apparatus of claim 12, wherein said second conduit has a second longitudinal axis, said second longitudinal axis being offset radially from said first longitudinal axis.

14. The apparatus of claim 13, wherein said heating vessel has a vessel longitudinal axis and said second longitudinal axis is offset radially from said vessel longitudinal axis.

* * * * *